US007491140B2

(12) United States Patent
DeGray

(10) Patent No.: US 7,491,140 B2
(45) Date of Patent: Feb. 17, 2009

(54) BASKETBALL RETURN DEVICE

(76) Inventor: Bryan DeGray, 4032 NW. 63rd St., Coconut Creek, FL (US) 33073

( * ) Notice: Subject to any disclaimer, the term of this patent is extended or adjusted under 35 U.S.C. 154(b) by 315 days.

(21) Appl. No.: 11/471,082

(22) Filed: Jun. 20, 2006

(65) Prior Publication Data

US 2006/0287138 A1 Dec. 21, 2006

Related U.S. Application Data

(60) Provisional application No. 60/691,677, filed on Jun. 20, 2005.

(51) Int. Cl.
*A63B 69/00* (2006.01)

(52) U.S. Cl. ..... 473/433; 473/447

(58) Field of Classification Search ..... 473/447, 473/446, 433, 432, 422; D21/704
See application file for complete search history.

(56) References Cited

U.S. PATENT DOCUMENTS 3,233,896 A * 2/1966 King ..... 473/433
3,814,421 A * 6/1974 Spier ..... 473/433
5,098,090 A 3/1992 Juhl
5,184,814 A 2/1993 Manning
5,348,290 A 9/1994 Matherne et al.
5,409,211 A * 4/1995 Adamek ..... 476/433
5,803,837 A 9/1998 LoFaso, Sr.
D545,929 S * 7/2007 DeGray et al. ..... D21/704

OTHER PUBLICATIONS http://www.arcangel.org/products/products.html.
http://www.thesportsauthority.com/sm-lifetime-hoop-chute-basketball-return—pi-14856.html.
http://www.onlinesports.com/pages/I,GAR-SHTMKR.html.

* cited by examiner

*Primary Examiner*—Gene Kim
*Assistant Examiner*—M Chambers
(74) *Attorney, Agent, or Firm*—Melvin K. Silverman; Yi Li

(57) ABSTRACT

The inventive system relates to a basketball training aid system including a cord-like basketball net having a central vertical axis, the net characterized by a plurality of cord segments and knots, and an entrance opening proportioned for attachment to a basketball rim. The net also exhibits an exit opening smaller than the entrance opening, each of the openings are concentric about the central vertical axis of the net. The system includes a mounting ring having a central vertical axis, the ring proportioned for securement to the net at about a center area of the vertical axis of the net in a plane substantially transverse to the axis, the ring includes means therein for its securement to the net at about the vertical center area of the vertical axis of the net. Further included in the system is a chute having an open entrance having a diameter greater than that of a basketball by an annular radius in a range of 1 to 2 inches, the chute entrance including an inner circumferential channel complemental in dimension to a circumferential edge of the mounting ring and proportioned for rotational motion about the ring.

12 Claims, 8 Drawing Sheets

BASKETBALL RETURN DEVICE

CROSS REFERENCE TO RELATED APPLICATION

This application claims the benefit under 35 USC 119(e) of provisional patent application Ser. No. 60/691,677, filed Jun. 20, 2005, which application is incorporated herein in its entirety by reference.

FIELD OF INVENTION

The present invention relates to devices intended to return a basketball to a shooter, more particularly, to those devices which will return the basketball to the location on the basketball court from which the basketball was shot.

BACKGROUND OF INVENTION

Practicing a skill repetitively has been proven to be a key factor in developing consistent skill performance in athletics. Repetitive practice is particularly important in the game of basketball. Basketball players typically spend a great deal of time repetitively practicing to improve their shooting performance. Unfortunately, a shot basketball which passes through the basketball net typically drops straight beneath that net. Thus, the practicing shooter must either rely upon an assistant to return the ball to him or her or must leave his or her shooting practice position to walk under the net to retrieve the ball.

The prior art includes a basketball return device for improving the utilization of individual shooting practice time having the basketball pass through the basketball net and be directed onto a curved track as shown in U.S. Pat. No. 5,098,090 to Juhl. The prior art also includes a basketball training device which is attached to a conventional basketball hoop by means of mounting clamps as shown in U.S. Pat. No. 5,184,814 to Manning and U.S. Pat. No. 5,348,290 to Matherne et al., which discloses a ball return apparatus and method that is also attached directly to the basketball hoop. Similarly, U.S. Pat. No. 5,803,837 to LoFaso, Sr. discloses a basketball practice device which is mounted to the basketball hoop or ring.

The above approaches have been found to be less than desirable because the shooters ability to focus on the rim and backboard is obstructed, the speed of the basketball return to shooter is slow, and the basketball is not returned to the shooter at a desired height.

It would be desirable to provide a basketball return device having improved features of a shooter's ability to focus on rim, hoop and backboard without visual obstruction, faster return of basketball, consistent return of basketball to any location within an 180° arc, and simplicity of installation. The present invention addresses these long felt needs in the art.

SUMMARY OF THE INVENTION

The inventive system relates to a basketball training aid system including a cord-like basketball net having a central vertical axis, the net characterized by a plurality of cord segments and knots, and an entrance opening proportioned for attachment to a basketball rim. The net also exhibits an exit opening smaller than said entrance opening, each of said openings concentric about said central vertical axis of said net. The system includes a mounting ring having a central vertical axis, said ring proportioned for securement to said net at about a center area of said vertical axis of said net in a plane substantially transverse to said axis, said ring including means therein for its securement to said net at about said vertical center area of said vertical axis of the net. Further included in the system is a chute having an open entrance having a diameter greater than that of a basketball by an annular radius in a range of 1 to 2 inches, said chute entrance including an inner circumferential channel complemental in dimension to a circumferential edge of said mounting ring and proportioned for rotational motion about said ring upon application of a tangential torque to said chute, said chute curving downwardly and off of said vertical axis to an outlet having an axis of ejection at an angle of between about 10 to about 20 degrees relative to a basketball playing surface, said chute having a substantially open frontal portion beginning below said open entrance beneath said channel for said mounting ring, said frontal portion progressively increasing in lateral surface area to about one-half of a circumference of a basketball and, therebelow, decreasing to a lateral surface area corresponding to about one-third of said circumference of a basketball at said outlet of said chute.

Whereby said chute may be readily rotated about said vertical axis of said net and ring by application of a force to said chute at a radius from said axis in any direction tangent to said mounting ring, thus effecting changes in a return direction of a basketball after it is ejected from said chute.

A center of gravity of said chute is sufficiently near to said vertical axis of said net as to not impart torques to said ring-to-net securement likely to displace said mounting ring from its said horizontal plane.

It is an object of the invention to provide an unobstructed view of the rim and backboard for the shooter to practice shots and have the basketball returned to the shooter.

Another object of the invention is to provide basketball return device that is simple to transport and easy to install.

It is yet another object of the invention to provide a stable basketball return device for constant and consistent returns to the shooter at a desired height.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
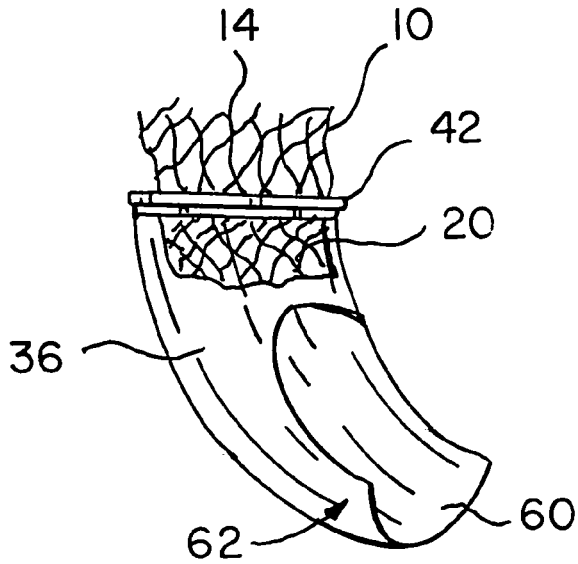
FIG. 1 is a side perspective view of the present inventive basketball training aid system.
Figure 2:
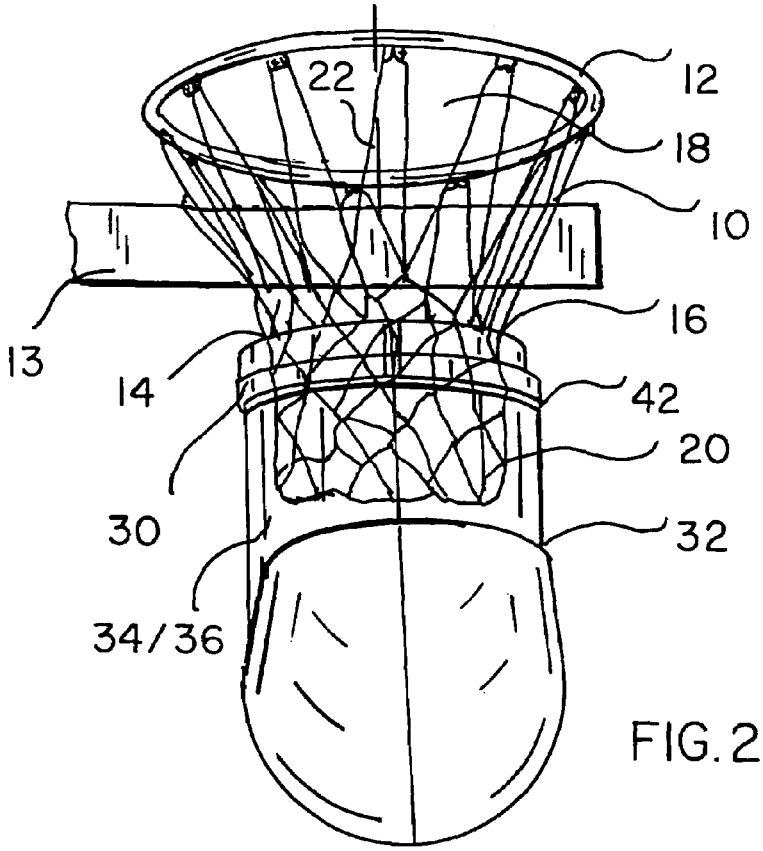
FIG. 2 is a front elevational view of the system shown in FIG. 1.
Figure 3:
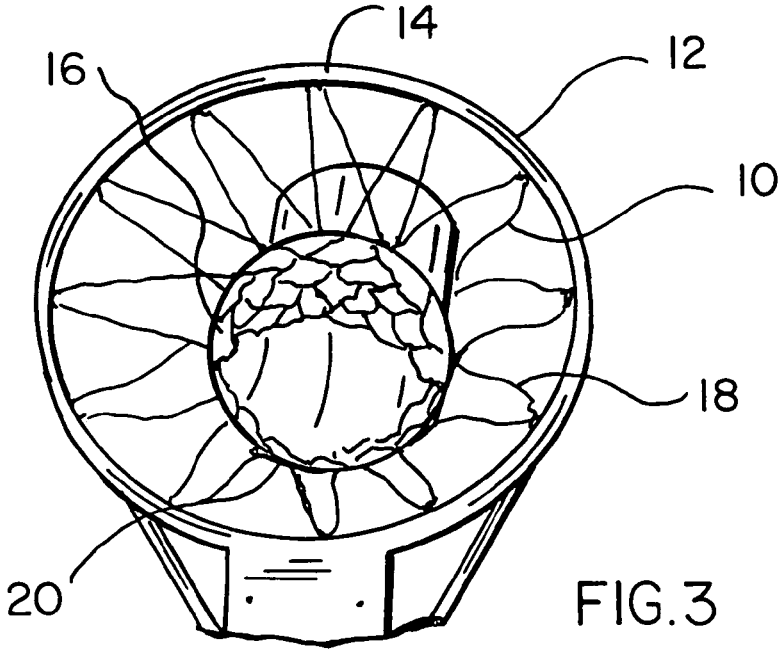
FIG. 3 is a top view, taken from above the level of a basketball rim.

With reference to the perspective views of FIGS. 1-3, it may be noted that the present basketball training aid system makes use of a standard cord-like basketball net 10 having an entrance opening 18 attached to a basketball rim 12 which is typically secured to a vertical support 13. Such standard cord-like basketball nets are characterized by a plurality of cord segments 14, the extent of each of which are defined by a plurality of knots 16 (see FIGS. 2-5). In such standard basketball nets, said opening 18 thereof corresponds to a diameter of rim 12 and an exit opening 20 of the net is smaller than said entrance opening, and smaller than the diameter of the basketball. Each of said openings 18 and 20 as well as the general geometry of the basketball net itself are concentric about a central vertical axis 22 (see FIGS. 2 and 6).

Figure 6:
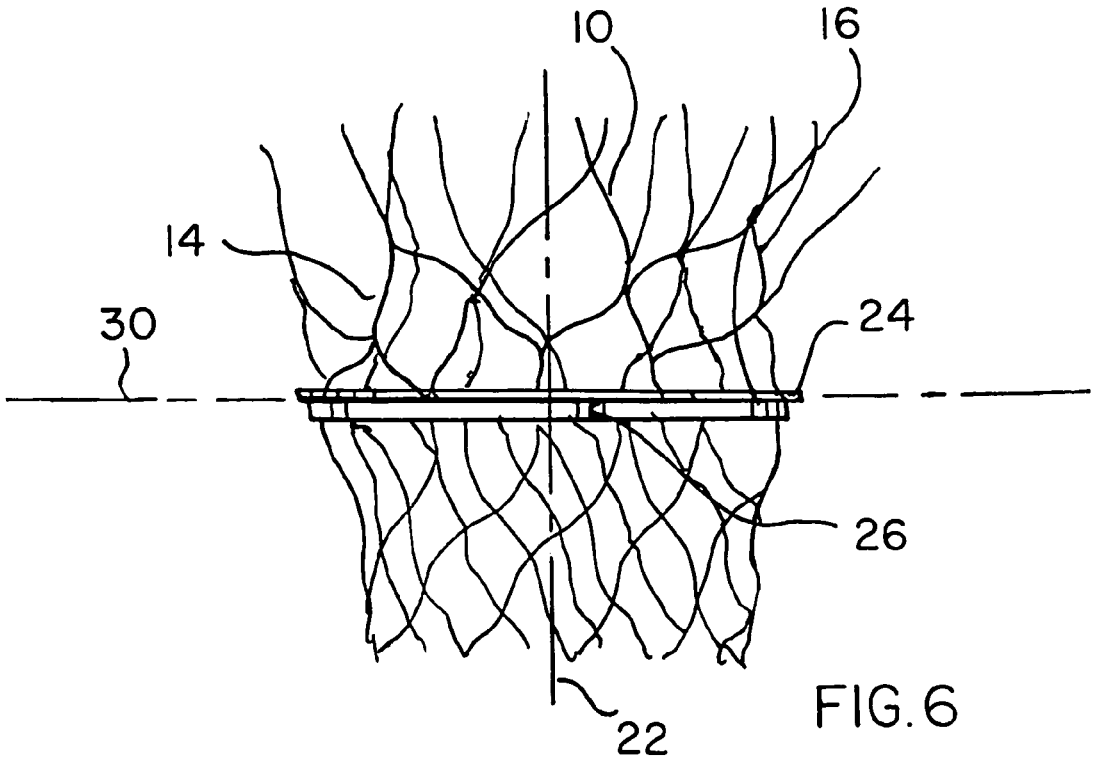
FIG. 6 is a view showing the mounting ring after it is completely attached to the basketball net.
Figure 5:
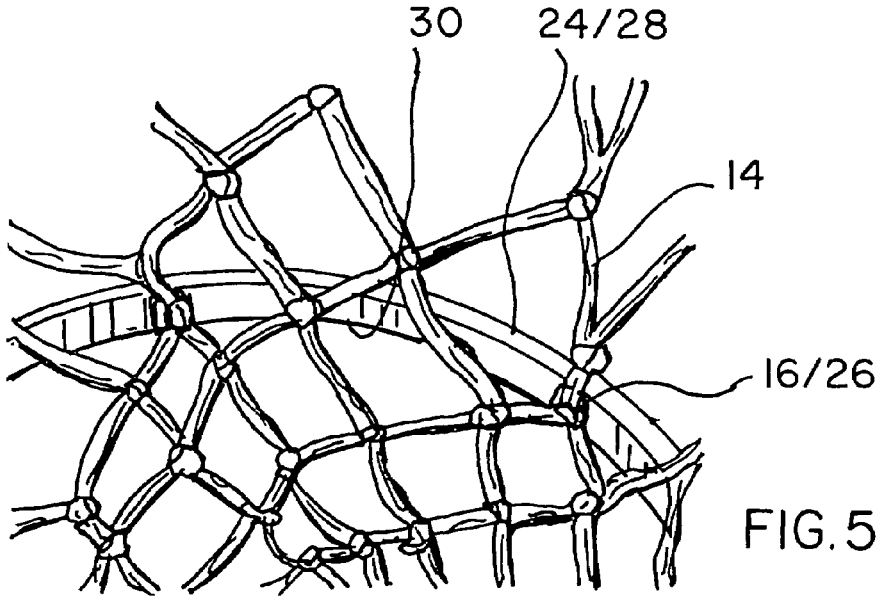
FIG. 5 is an operational view showing t he manner of attachment of the mounting ring to a basketball net.
Figure 4:
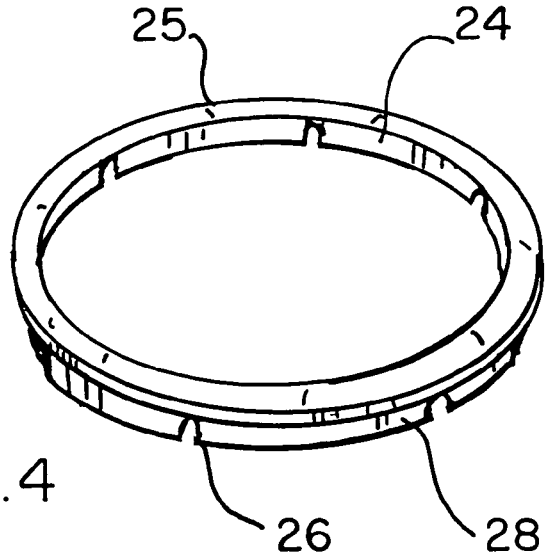
FIG. 4 is a perspective view of the mounting ring of the system.
Figure 7:
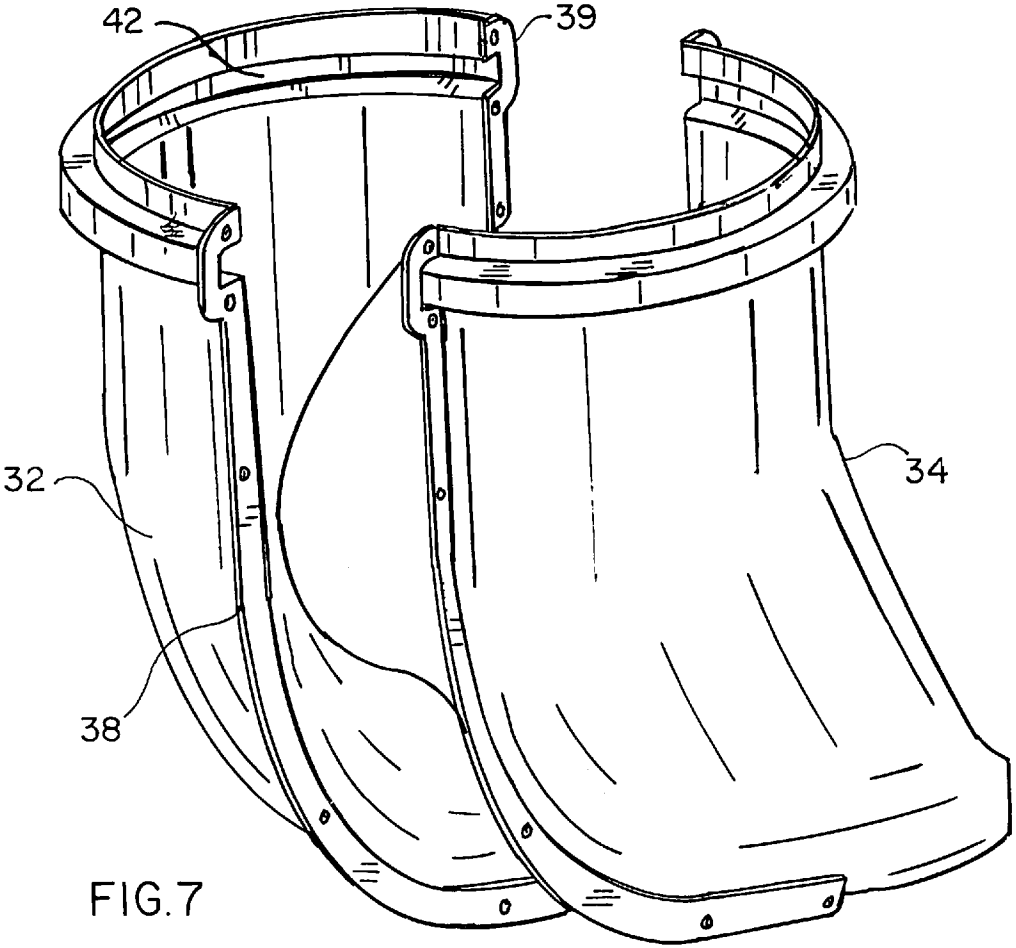
FIG. 7 is an exploded view showing symmetric left and right sides of the chute of the system prior to assembly thereof.

Shown in FIG. 4 is a chute mounting ring 24 which is rigid circular structure having an inner diameter of about 11.5 inches and a shoulder 25 having an outer diameter of about 13 inches. Ring 24 also includes a plurality of vertical slots 26 which depend upwardly within a vertical circumferential surface 28 of the ring. Said slots 26 are proportioned for engagement about knots 16 of the net. The manner of such engagement is shown in FIGS. 5 and 6. Therefrom, it may be noted that slots 26 simply slip over selected knots 16 located within a horizontal plane 30 (see FIGS. 2, 5, and 6) which is transverse to said vertical axis 22 at about a center area thereof. However, as may be noted in FIGS. 1 and 2, mounting ring 24 may be located slightly below the center of axis 22, that is, below plane 30. After the mounting ring has been so secured to net 10, respective parts 32 and 34 of chute 36 (see FIGS. 7 and 8) may be assembled along planar interfaces 38 through the use of screws, bolts, rivets or the like. As may be noted in FIGS. 8-10, an entrance opening 40 of chute 36 exhibits a diameter greater than that of a basketball by an annular radius in a range of 1 to 2 inches. Further, immediately below opening 40 is provided an inner circumferential channel 42 (see FIGS. 7-9) which is complemental in diameter to the outermost circumferential edge of ring shoulder 25 of mounting ring 24. This may be appreciated with reference to FIG. 9 which shows the rotationally moveable positioning of ring 24 within said circumferential channel 42 of opening 40 of chute 36. The requisite degree of friction between an outer circumferential surface of ring shoulder 25 and the inside diameter of circumferential channel 42 is assured by a proper tightening of parts of interfaces 38 at region 39 (see FIG. 7) and by a slight difference in dimensionality between the shoulder 25 of mounting ring 24 and said inner diameter of circumferential channel 42, which are within a few millimeters of each other, and which assure stability of chute 36 relative to ring 24 in both the chute's fixed mode of use as well as upon its rotation (below described) relative to ring 24.

Figure 8:
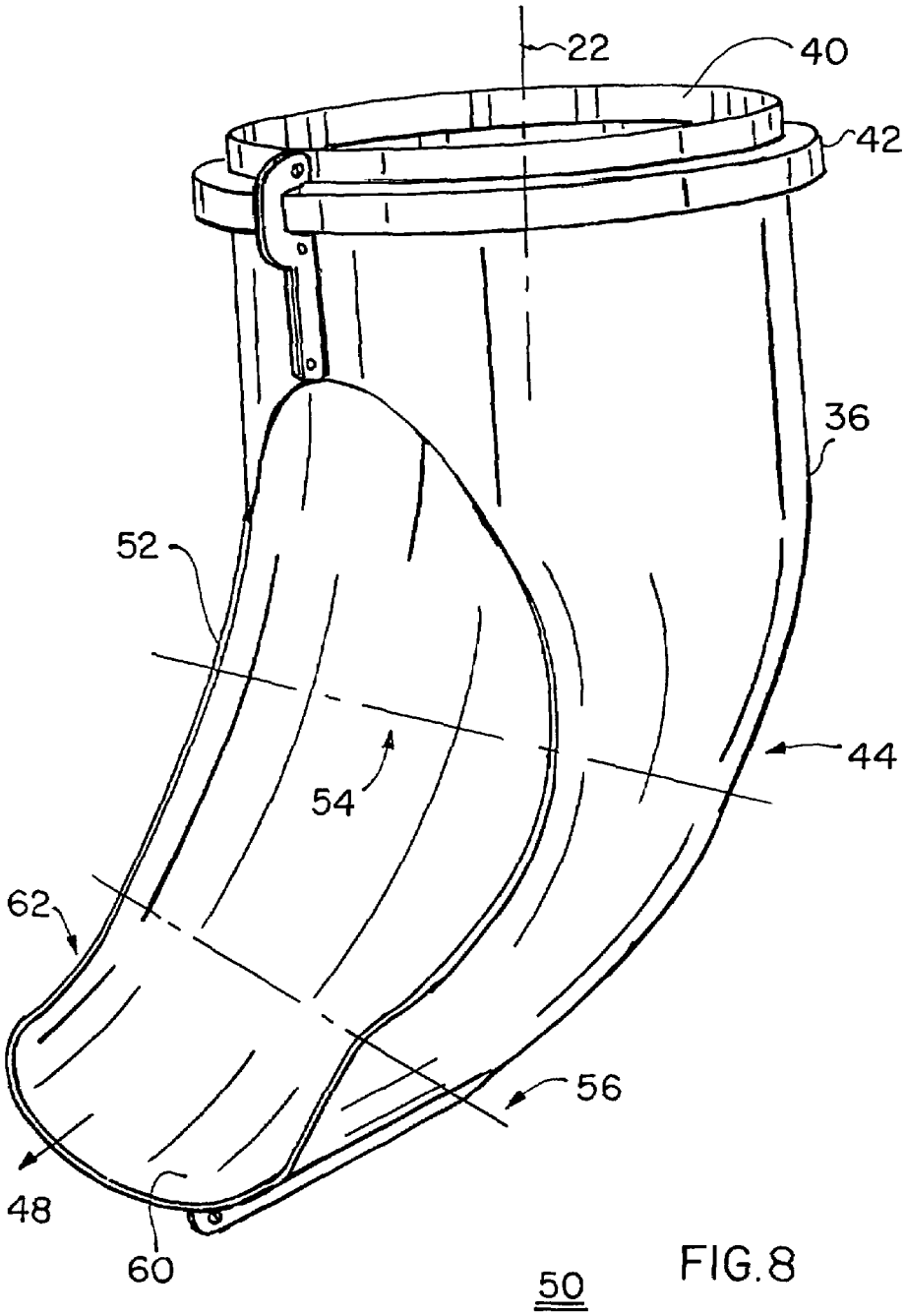
FIG. 8 is an assembly view of the chute of FIG. 7.
Figure 9:
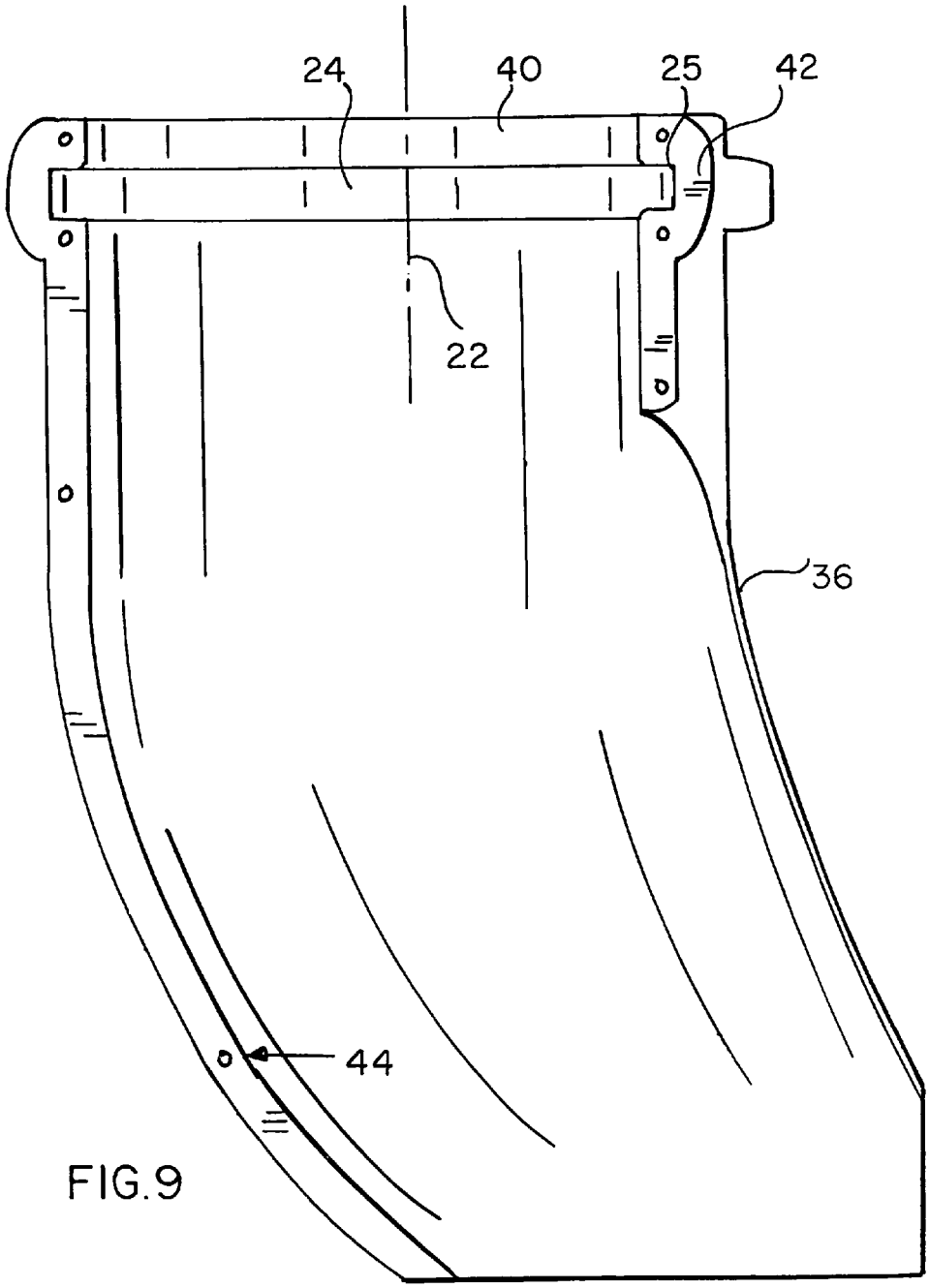
FIG. 9 is a vertical diametric cross-sectional view taken through the plane of attachment of the left and right portions of the chute in which engagement of the mounting ring by a channel within an entrance area of the chute is also illustrated.
Figure 10:
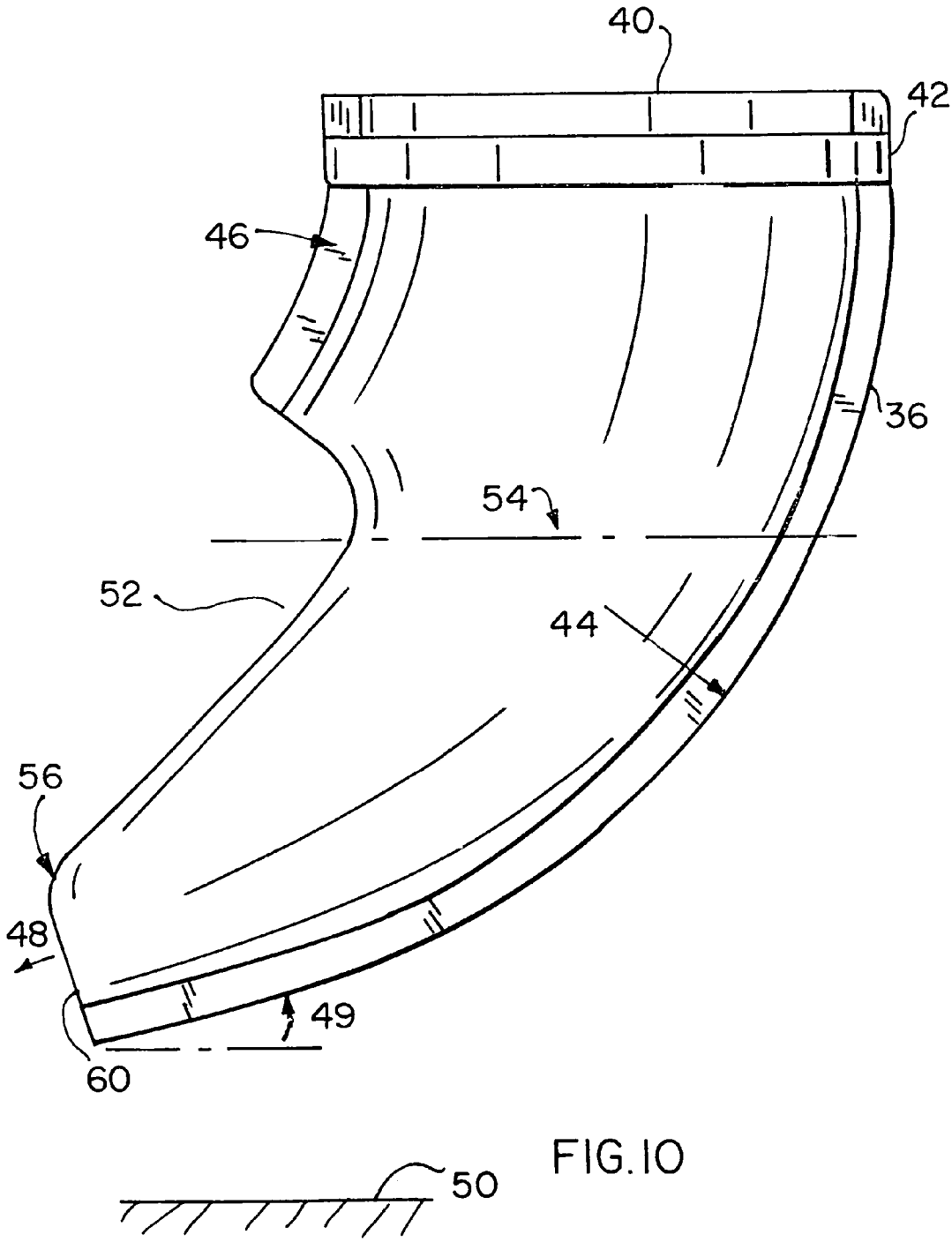
FIG. 10 is a right side vertical cross-sectional view of the chute of FIG. 8 showing the curvature of front and rear surfaces thereof.

As may be noted in the views of FIGS. 8 and 10, beneath circumferential channel 42, the original vertical axis 22 of chute 36 bends gradually away from the vertical at an outside radius 44 of about 30 inches and at an inside radius 46 of about 6 inches. The result of this combination of curves results in an axis of ejection 48 that may be in a range 49 of about 10 to about 20 degrees relative to a basketball playing surface 50. This angle, it has been found, assures that a basketball ejected from chute 36 will typically land a distance of about 6 to 9 feet away from the rim, which has been found to be a convenient distance for purposes of basketball shot training. As may be noted in FIGS. 8, 10 and 11, open frontal portion 52 of the chute progressively increases in lateral surface area to a maximum circumference, obtained at plane 54, which corresponds to about one-half of the circumference of a basketball. Therebeneath, the lateral surface area of chute 36 gradually narrows until, at line 56 the later surface area of chute 36 is about one-third the circumference of a basketball. Further, exit opening 60 of the chute defines a lateral surface area which generally follows the circumference of a basketball, thereby assuring a faster and more accurate axis of ejection 48 of the ball from the chute 36 in the direction of the player.

Figure 11:
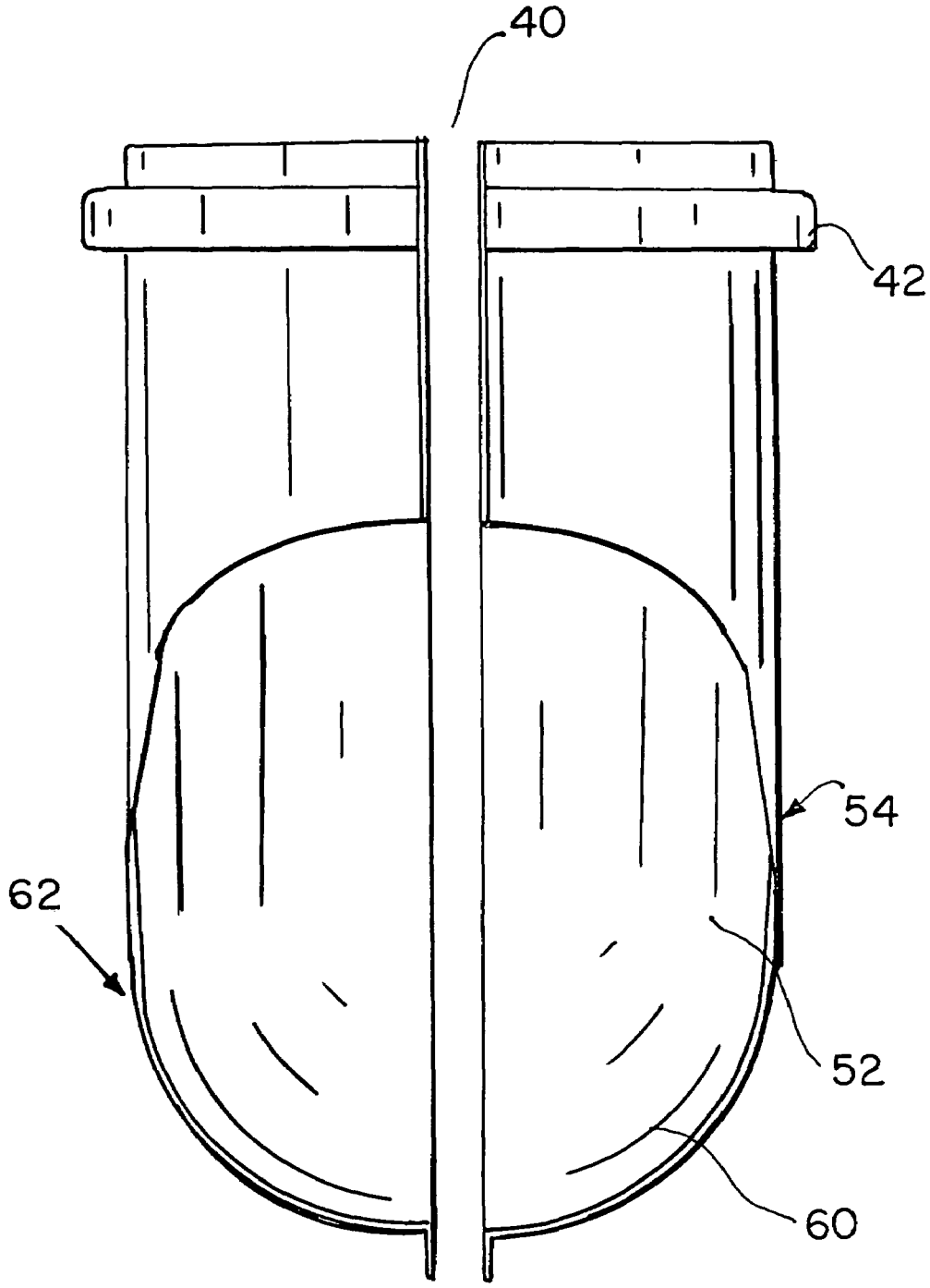
FIG. 11 is a front elevational view of FIG. 8 showing the respective left and right sides of the chute immediately prior to their engagement about the mounting ring of the system.

By virtue of the above described circumferential channel 42 which surrounds mounting ring 24, chute 36 may be readily rotated about vertical axis 22 by the application of force in any direction tangent to the mounting ring, for example, direction 62, shown in FIGS. 1, 8 and 11.

The vertical height of chute 36 when attached to the net is in a range of about 20 to about 24 inches, with 22.5 inches being optimal. Further, the weight of the chute 36 is in a range of about 3.8 to about 4.2 pounds, with about 4 pounds being optimal. The weight of the mounting ring 24 is optimally about 4 ounces. The above size and weight of the present system, together with the above defined radii of curvature 44 and 46 have been found to produce a center of gravity of the chute which is sufficiently near to vertical axis 22 so that undue torques are not imparted to the ring-to-net securement effected between the above-described ring slots 26 and net knots 16, thus defining a horizontal plane of the mounting ring that is not compromised during normal usage of the inventive system. As such, the integrity of such parameters as axis 48 of ejection from chute 36 and momentum of the basketball ejected therefrom are not affected. The chute is preferably formed of a polymeric material such as acrylonitrile butadiene styrene ("ABS") but may also be formed of polypropylene, K-RESIN, or KRATON using any well-known injection molding process. The mounting ring is preferably formed of a polymeric material such as polycarbonate, but may also be formed of ABS. As may be noted in FIGS. 7, 8 and 11, parts 32 and 34 of chute 34 are preferably molded in complete symmetry, both for purposes of simplicity of assembly and to assure stability of the center of gravity of the system.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A basketball training aid system including a cord-like basketball net having a central vertical axis, the net characterized by a plurality of cord segments and knots, and an entrance opening proportioned for attachment to a basketball rim and also an exit opening smaller than said entrance opening, each of said openings concentric about said central vertical axis of said net, said system including:

(a) a mounting ring having a central vertical axis, said ring proportioned for securement to said net at about a center area of said vertical axis of said net in a plane substantially transverse to said axis, said ring including means therein for its securement to said net at about said vertical center area of said vertical axis of the net; and (b) a chute having an open entrance having a diameter greater than that of a basketball by an annular radius in a range of 1 to 2 inches, said chute entrance including an inner circumferential channel complemental in dimension to a circumferential edge of said mounting ring, said channel defining chute-to-ring securement means comprises a plurality of vertical slots depending upwardly within a vertical circumferential surface thereof, said slots proportioned for engagements of knots of said basketball net, said channel proportioned for rotational motion about said ring upon application of a tangential torque to said chute, said chute curving downwardly and off of said vertical axis to an outlet having an axis of ejection at an angle of between about 10 to about 20 degrees relative to a basketball playing surface, said chute having a substantially open frontal portion beginning below said open entrance beneath said channel for said mounting ring, said frontal portion progressively increasing in lateral surface area to about one-half of a circumference of a basketball and, therebelow, decreasing to a lateral surface area corresponding to about one-third of said circumference of a basketball at said outlet of said chute, whereby said chute may be readily rotated about said vertical axis of said net and ring by application of a force to said chute at a radius from said axis in any direction tangent to said mounting ring, thus effecting changes in a return direction of a basketball after it is ejected from said chute.

2. The system as recited in claim 1, in which a vertical height of said chute when attached to said net is in a range of about 20 to about 24 inches.

3. The system as recited in claim 2, in which the weight of said chute is in a range of about 3.8 to about 4.2 pounds exclusive of the weight of said ring.

4. The system as recited in claim 3, in which the weight of said mounting ring is about 4 ounces.

5. The system as recited in claim 2, in which a radius of curvature of the back of said chute along surfaces of securement between symmetric left and right parts thereof is about 30 inches.

6. The system as recited in claim 5, in which a radius of curvature of the front of said chute along a surface of securement between symmetric left and right sides of the chute is about 6 inches.

7. The system as recited in claim 2, in which an internal diameter of said ring is about 11.5.

8. The system as recited in claim 7, in which the internal diameter of said internal circumferential channel of said chute ring is about 12 inches.

9. The system as recited in claim 2, in which said chute may be formed and assembled in symmetric left and right parts.

10. The system as recited in claim 2, in which said chute may be made by injection and molding.

11. The system as recited in claim 2, in which a center of gravity of said chute is sufficiently near to said vertical axis of said net as to not impart torques to said ring-to-net securement likely to displace said mounting ring from its said horizontal plane.

12. The system as recited in claim 1, in which said chute is formed of a polymeric material including acrylonitrile butadiene styrene ("ABS"), polypropylene, K-RESIN or KRATON.

* * * * *